US011441743B2

(12) United States Patent
Jones

(10) Patent No.: US 11,441,743 B2
(45) Date of Patent: Sep. 13, 2022

(54) NIGHT HUNTING SPOTLIGHT WITH REAR-LOCATED CONTROLS FOR INTENSITY, ZOOM-FLOOD, AND LOCK

(71) Applicant: AllPredatorCalls.com, Inc., St. George, UT (US)

(72) Inventor: Andrew Paul Jones, St. George, UT (US)

(73) Assignee: AllPredatorCalls.com, Inc., St. George, UT (US)

( * ) Notice: Subject to any disclaimer, the term of this patent is extended or adjusted under 35 U.S.C. 154(b) by 0 days.

(21) Appl. No.: 17/197,528

(22) Filed: Mar. 10, 2021

(65) Prior Publication Data

US 2022/0082215 A1 Mar. 17, 2022

Related U.S. Application Data

(60) Provisional application No. 63/077,812, filed on Sep. 14, 2020.

(51) Int. Cl.

| | |
|---|---|
| ***F21L 4/04*** | (2006.01) |
| ***F21V 15/01*** | (2006.01) |
| ***F21V 5/04*** | (2006.01) |
| ***F21V 14/02*** | (2006.01) |
| ***F21V 23/00*** | (2015.01) |
| ***F21L 4/02*** | (2006.01) |
| ***F21V 21/22*** | (2006.01) |
| ***F21L 4/00*** | (2006.01) |
| ***F21Y 113/13*** | (2016.01) |
| ***F21Y 115/10*** | (2016.01) |

(52) U.S. Cl.

CPC ..... *F21L 4/045* (2013.01); *F21L 4/027* (2013.01); *F21V 5/048* (2013.01); *F21V 14/025* (2013.01); *F21V 15/01* (2013.01); *F21V 21/22* (2013.01); *F21V 23/009* (2013.01); *F21L 4/005* (2013.01); *F21Y 2113/13* (2016.08); *F21Y 2115/10* (2016.08)

(58) Field of Classification Search

CPC ... F21L 4/04; F21L 4/045; F21L 4/027; F21V 14/02; F21V 14/025; F21V 21/22

See application file for complete search history.

(56) References Cited

U.S. PATENT DOCUMENTS 5,400,227 A * 3/1995 Maglica ..... F21L 4/005 362/188
6,866,401 B2 * 3/2005 Sommers ..... F21V 14/065 362/268

(Continued)

FOREIGN PATENT DOCUMENTS

CN 103206617 A * 7/2013 ..... F21V 5/04
WO WO-03025458 A1 * 3/2003 ..... F21V 5/007
WO WO-2005089149 A2 * 9/2005 ..... F21V 19/047

*Primary Examiner* — Alan B Cariaso

(74) *Attorney, Agent, or Firm* — Gurr Brande & Spendlove, PLLC; Robert A. Gurr

(57) ABSTRACT

A night hunting spotlight has a fixed lens, a fixed bezel, and a light-emitting diode (LED) movable in relation to the fixed lens so as to broaden or narrow the beam, respectively. The LED may be movable using telescoping mechanisms, rotating mechanisms, knobs, linear actuators (manually actuated or electronically controlled), or other mechanisms capable of moving the LED along the longitudinal axis of the night hunting light to approximate the lens or move distally therefrom.

13 Claims, 8 Drawing Sheets

(56) References Cited

U.S. PATENT DOCUMENTS

| | | | | |
|---|---|---|---|---|
| 9,964,286 | B1 * | 5/2018 | Sooferian | F21V 13/02 |
| 2007/0200466 | A1 * | 8/2007 | Heim | H01L 41/0986 310/311 |
| 2012/0300442 | A1 * | 11/2012 | Popper | F21V 14/025 362/184 |
| 2013/0329411 | A1 * | 12/2013 | Windom | F21V 13/04 362/188 |
| 2020/0103094 | A1 * | 4/2020 | Stevenson | F21V 19/001 |

* cited by examiner

NIGHT HUNTING SPOTLIGHT WITH REAR-LOCATED CONTROLS FOR INTENSITY, ZOOM-FLOOD, AND LOCK

CROSS-REFERENCE TO RELATED APPLICATIONS

This application claims the benefit of U.S. Provisional Application Ser. No. 63/077,812, filed on Sep. 14, 2020, which is incorporated herein by reference.

TECHNICAL FIELD

The present disclosure relates to night hunting spotlights. More particularly, the present disclosure relates to night hunting spotlights (mountable on firearms, handheld, headlamps, etc.) with an improved rear-mounted mechanism for zoom/flood functionality.

BACKGROUND

Night hunting is an extremely popular sport around the world. In the sport of nighttime predator and invasive feral and pest species hunting (e.g., coyote, fox, jackal, feral hog, wild boar, leopard, rat, bobcat, deer, etc.), a very common technique is to use spotlights to shine on open or baited areas (known as "scanning") while playing recordings of distressed indigenous game or livestock animals, such as rabbits, deer, or goats (in the case of predatory animals). When light shines into the eye of an animal having a tapetum lucidum, the pupil appears to glow brightly (referred to as "eyeshine"). A spotlight is sufficient to produce eyeshine that is highly visible to humans at distances of several hundred yards. As such, spotlighting is used by naturalists and hunters to search for animals at night.

When the responding predator arrives in the area, the shined light causes the animal's eyes to reflect brilliantly, alerting the hunter or naturalist as to the animal's arrival on scene. The scanning light beam characteristic is particularly important because virtually all modern spotlights designed for use in night hunting, when focused at high intensity (tight beam diameter), regardless of beam color (white, red, green, etc.), have the potential of spooking or "shying" the animal from the light, or overwhelming the animal's eyes with bright, high-intense light causing it to flee the area. Because of this, a spotlight with an adjustable light beam is very desirable. The hunter or naturalist can flood the light (widen the beam) which causes the beam intensity to lower and illuminates a larger area with lower intensity light as opposed to a focused beam of higher intensity.

The benefit of illuminating a large area with low intensity light is twofold. First, a common technique used in successful nighttime predator hunting is to continuously scan the light in a 180-degree arc in front of the hunter while playing distress recordings of prey species for up to 30 minutes to 1-hour. Due to the repetitive nature of quickly scanning a spotlight (handheld, headlamp, or scope mounted) back and forth continuously for a long duration, the beam width quickly becomes a factor—the wider the beam, the less the hunter has to move their arm, head, or torso to illuminate the 180-degree arc in front of them. In essence, a wider beam is much more desirable as it requires less motion, and is therefore less fatigue-inducing, to scan an area as compared to a narrow, tight light beam. Secondly, scanning a larger area with low intensity light increases the potential of detecting "eye" reflection and reduces the potential of spooking a target animal responding to the distress recording.

However, not all animals have tapetum lucidum. For example, wild boar and feral hogs are an animal frequently hunted at night, but they lack the tapetum lucidum. Because of this, a light is needed that illuminates the body of the wild boar or feral hog so the hunter can detect the animal body or silhouette, alerting the hunter to its presence; however, the light cannot be of such a high intensity as to startle or scare the animal, causing it to vacate the area. The hunter can then slowly increase the light intensity by focusing the beam, positively identify the animal in combination with a scope mounted light, put the scope cross hairs in the desired spot (kill zone), while paying attention to not overwhelming the animal's eyes with bright, high-intensity light, and causing it to flee the area.

Until recently (last 5-7 years), most night hunting lights were typically of a "fixed beam" design—meaning that the focal length could not be adjusted. The beam characteristic is set during the design and manufacturing process, be it "flood" for flooded illumination of the immediate area, or "zoom" which is focused for highest intensity and range, or a point in-between to share characteristics of both. Lens selection and reflector finish also could be optimized to enhance said beam characteristics.

Often, hunters would purchase two lights for hunting: one for scanning with a lower intensity "flooded" beam which is more optimized for scanning and eye reflection; and a "shooting" light for use attached to a scoped weapon, which has a brighter, smaller-focused beam for maximum range for shooting.

More recently, a more powerful class of larger diameter bezel spherical lens hunting spotlights with zoom to flood (also known as "zoom—flood") bezels have become available. The zoom—flood design bezel lights typically feature one or more deep rotational groove(s) on the light body which pair with the light bezel assembly allowing for telescoping bezel rotation around the light body, which changes the fixed position Light Emitting Diode (LED) focal distance from the surface of the bezel-mounted spherical lens much the same way a magnifying glass's focus is manipulated by raising and lowering it in relationship to a surface. The resulting rotational manipulation allows the light to be adjusted from "flood" with its lower intensity wider beam, to "zoom" with its higher intensity focused smaller light beam.

The desirable characteristics of the zoom—flood bezel light allow hunters to utilize a single scope-mounted light for both scanning and shooting, or two lights: one optimized for scanning by hand or a headlamp, and one optimized to full brightness intensity and mounted on a scoped weapon to be used in combination with optics to positively identify and shoot the targeted species.

Although there are multiple night hunting techniques, in the case of a single scope mounted light, a very common technique is to start scanning with a lower intensity "flooded" beam which is optimized for scanning and eye reflection and has less potential to spook or shy the targeted species from the light. When eyes are detected, the hunter simply reaches up and rotates the light bezel from "flood" to full "zoom," which increases the light intensity as it reduces the beam diameter. This is done to positively identify the species as viewed through a scoped weapon and aid in shooting as required.

Although the current generation zoom—flood bezel night hunting lights are a vast improvement in versatility as compared to the previous generation of fixed-beam hunting lights, they are not, however, without serious design limitations and flaws when used for night hunting.

The zoom—flood focus bezel design is often constructed from a metal alloy such as aluminum, which houses a spherical lens, commonly 65 mm in diameter, that is constructed from glass or plastic. Overall length sized to provide appropriate focus plane distances from a fixed position LED located in the light body and with substantial machining tolerances of such that smooth, easy rotation with the use of two opposing fingers from zoom—flood occurs from as little as ¼ bezel rotation in one design, to more than 1½ complete revolutions in another. These rotating bezel design characteristics result in substantial bezel weight and mass.

Because of weight and mass of the bezel, built-in rotational tolerances, and the nature of spherical lens light physics, a frustrating limitation is readily apparent when utilizing the zoom—flood design light on a scoped weapon while peering through the scope. Because of the bezel groove(s) design, when adjusting the zoom—flood of the beam, the range of motion experienced can move the beam out of alignment with the scope crosshair, causing the target to momentarily lose illumination. Additionally, there may also be a loss of illumination intensity on the target because the LED is not perfectly centered in the spherical lens. This loss of centering occurs when the bezel is slightly deflected off axis. Because of manufacturing tolerances, the leverage expended by hand-rotating, and the incidental torquing effect on the bezel, combined with the weight of the bezel, is such that minute, angle of degree offsets are induced during rotation, which shift the bezel, which houses the spherical lens assembly, off center-line of the LED centerline, which causes the light beam trajectory to change slightly and or illumination reduction from full potential. The loss of target illumination, momentary target acquisition, and/or loss of light intensity while peering through a scope and "zooming" or "flooding" the light beam characteristic and intensity, presents an obvious design limitation, particularly when trying to positively confirm a target species prior to shooting.

Several attempts to prevent and minimize bezel offset movement during bezel rotation of zoom—flood, as described above, have been adopted by manufacturers with marginal improvement. For example, O-rings have been added forward and rear of rotational groove(s) on the light body to prevent bezel deflection during rotation. By filling spaces made as a result of manufacturing tolerances and allowing direct contact between the rubber O-ring, the light bezel, and light body while trying to provide resistance free rotation, slight improvement is obtained. However, the addition of O-rings has often substituted one problem for another as they can restrict the free smooth movement of the mechanism, particularly in cold weather conditions when the O-rings often become hard and brittle. Additionally, the accumulation of debris, dust, sand, water, ice, etc. (often encountered in outdoor hunting conditions) can cause accelerated wear and breakage of O-rings, resulting in jamming of the zoom-focus bezel mechanism itself.

The design and location of the zoom—flood mechanism on a zoom-flood hunting light by its nature is problematic. The physical mechanics of the operator having to use either their dominate trigger hand, or non-dominate support hand, and breaking secure contact with the stock, moving their arm 8 to 12 inches, and using their hand to grab the bezel, then forcefully rotating the bezel to change the light beam characteristic, while the light is mounted on a scope, while peering through the objective lens of the optic, presents safety, target identification, and accuracy issues. The movements and actions often cause the operator to break hand, shoulder, and "cheek weld" contact with the weapon's stock while manipulating the zoom—flood bezel. While loss of hand and shoulder contact with a loaded weapon presents obvious safety concerns, "cheek weld" refers to the firm contact that your cheek should make with the top of your stock. When adjusted properly, good cheek weld should allow your dominant eye to comfortably look straight into your scope or sights and profoundly increase shooting accuracy.

The common usage of scope mounted windage and elevation adjustable light mounts, which allow the user to accomplish instant "thumb wheel" adjustments, is another area of deficiency when used in combination with the current zoom-flood bezel light design. The adjustable mount thumb wheels compress or relieve tension on internal springs that provide resistance to thumb wheel rotation and allow for multiple degrees of travel of the light mount on the vertical and/or horizontal plane, depending on which thumb wheel is manipulated. The adjustable mounts allow the user to attach a light to a particular scoped weapon and adjust and optimize the focused light beam to the center of the crosshairs for that particular light, scope, and weapon combination. However, this design, which allows for quick and easy adjustment inputs when the thumb wheels are rotated, is sensitive to deflection and movement. When the bezel is rotated, because of manufacturing tolerances within the adjustable mount, the leverage expended by hand rotating and the incidental torquing effect on the bezel, combined with the weight of the light bezel, is such that internal spring compression can occur and minute, angle of degree offsets are induced during rotation, which shift the light beam adjustment and trajectory during the act of bezel rotation. As previously discussed, any loss of target illumination, momentary target acquisition, and/or loss of light intensity while peering through a scope and zooming or flooding the light intensity presents an obvious design safety limitation, particularly when trying to positively confirm a target species prior to shooting.

Additionally, current art and design of bezel-adjustable zoom-flood hunting lights provide no "bezel lock" to prevent accidental movement or rotation of the bezel after it is adjusted and optimized in a particular position. As often is the case, night hunting rifles are secured in either hard or soft-sided cases, or gunracks when being transported from one stand location to another at night. The typical night hunting outing can involve eight-to-fourteen night hunting stands in a full evening of night hunting. Because of repetitive securing and rendering safe for transportation, the zoom—flood light design is susceptible to bezel movement and rotations from incidental contact with cases, racks, padding material, etc. Even small movements or adjustments to the light bezel can cause profound changes in beam characteristics. The inferior, no-lock design, bezel necessitates the need to physically turn "ON" the light at each stand to verify that the beam with scope crosshairs has not changed during transportation and to re-adjust, as necessary. In some situations, turning the high intensity "shooting light" on before starting to play the distress recordings, or the scanning with low intensity light for "eyes," is very undesirable, and, depending on species or hunting technique in use, can alert or spook the target species.

Accordingly, there is a need for a night hunting spotlight that may easily be adjusted to zoom—flood by a user, may zoom—flood without adjusting the bezel, and be secured in a desired zoom—flood position. The present disclosure seeks to solve these and other problems.

SUMMARY OF EXAMPLE EMBODIMENTS

In one embodiment, a night hunting spotlight comprises a bezel portion, a body portion, and a tail cap portion. The bezel portion comprises a bezel, a lens, and front cover coupleable to the bezel. The bezel portion further comprises an LED module having one or more colored LEDs. The body portion comprises an inner housing and an outer housing. The inner housing comprises a power supply (e.g., a battery) therein. Further, the inner housing may be operably coupled to a telescoping rotator, which may axially extend or retract the inner housing within the outer housing and, ultimately, extend and retract the LED module. When the LED module extends toward or retracts away from the fixed lens, the light beam will broaden (e.g., flood) or narrow (e.g., zoom), respectively, which also decreases or increases the light intensity.

In one embodiment, the body portion may further comprise a lock to fix the position of the LED module in relation to the lens. In the tail cap portion, an intensity control (e.g., a rheostat) may further adjust the light intensity.

In one embodiment, a night hunting spotlight comprises a fixed lens, a fixed bezel, and an LED module movable in relation to the fixed lens so as to broaden or narrow the beam, respectively. The LED module may be movable using telescoping mechanisms, rotating mechanisms, knobs, linear actuators (manually actuated or electronically controlled), or other mechanisms capable of moving the LED module along the longitudinal axis of the night hunting light to approximate the lens or move distally therefrom.

DETAILED DESCRIPTION OF EXAMPLE EMBODIMENTS

Figure 1:
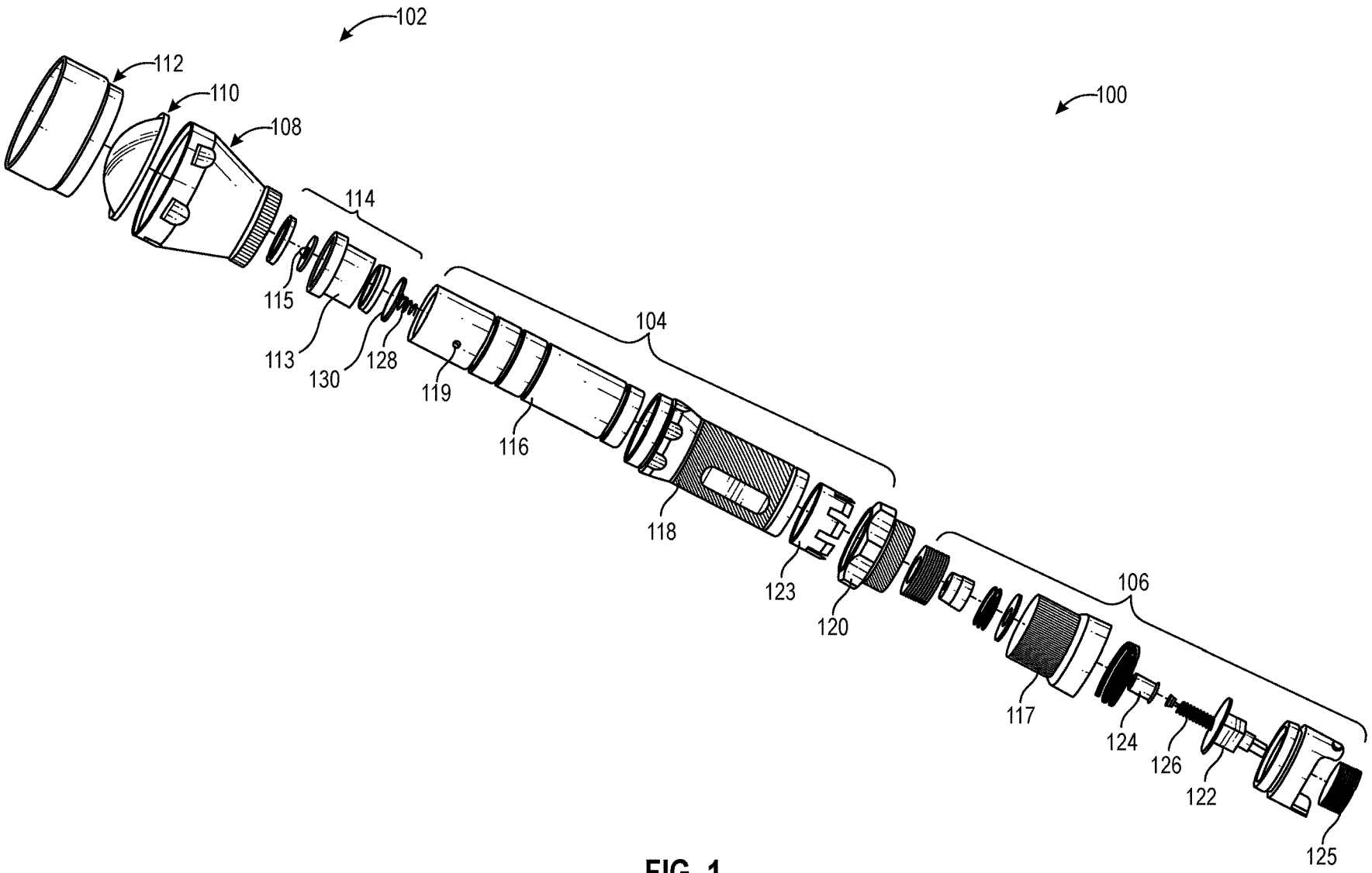
FIG. 1 illustrates an exploded view of a night hunting spotlight.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As discussed earlier, there is a need for a night hunting spotlight that 1) may easily be adjusted to zoom—flood by a user, 2) may zoom—flood without adjusting the bezel, and 3) be secured in a desired zoom—flood position. The present disclosure seeks to solve these and other problems.

In the prior art, typical hunting spotlights adjust the zoom—flood via a rotational mechanism coupled to the bezel. In other words, to adjust the spotlight, a user has to rotate the bezel, extending and retracting the bezel, which can change the projection angle of the light beam. When the spotlight is coupled to a firearm, even a slight angle change of the light beam may frustrate a user due to a user needing to reacquire the target.

On the other hand, the night hunting spotlight described herein generally comprises a mechanism that extends or retracts an LED module in relation to the bezel, instead of the bezel itself. In one example, a telescoping rotator is the mechanism used to move the LED module, although other mechanisms may be used. It will be appreciated that the telescoping rotator limits unwanted movement of the beam of the night hunting spotlight, allowing a user to stay on target and make quick, easy adjustments.

Figure 2:
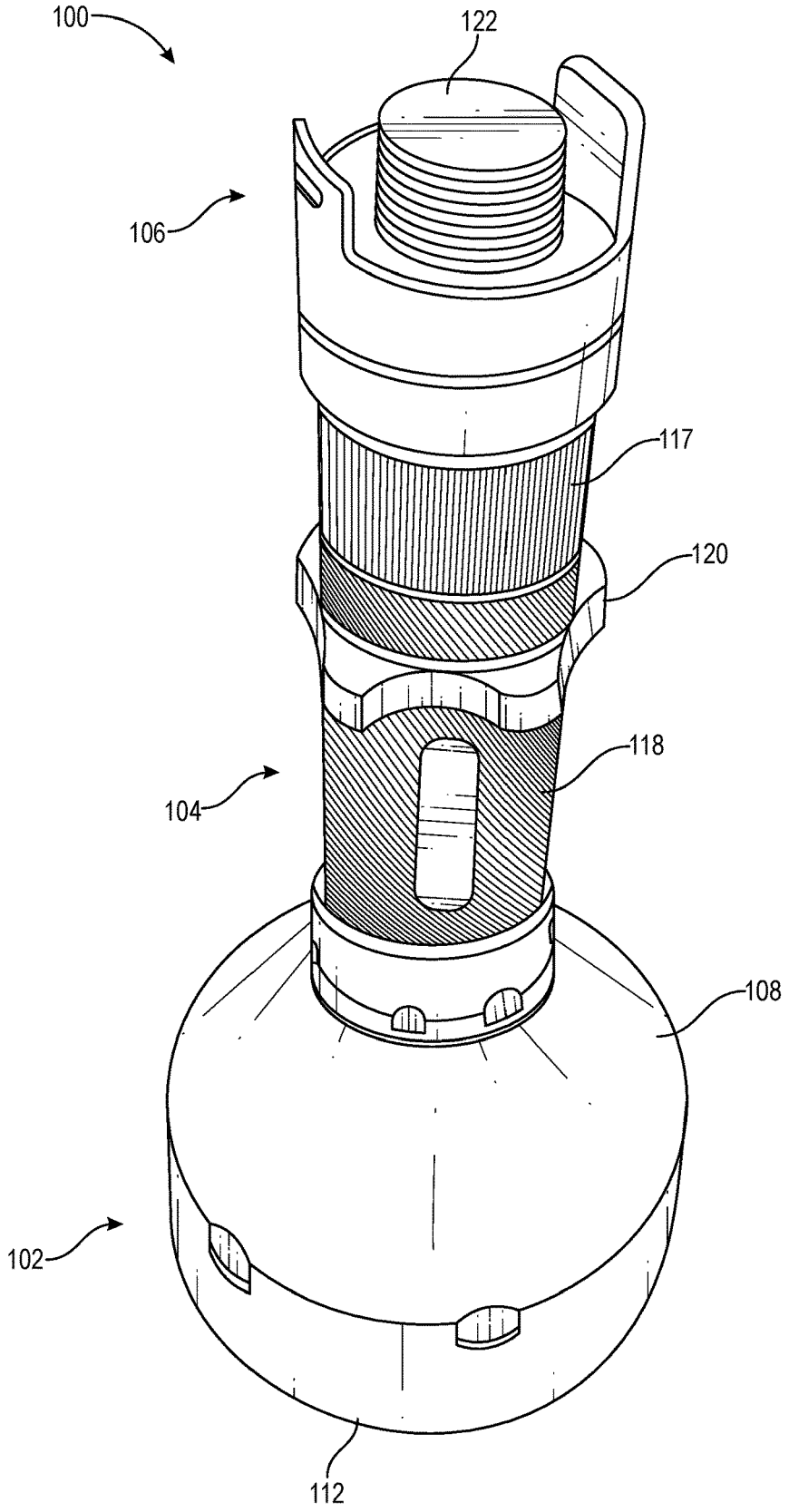
FIG. 2 illustrates a rear perspective view of a night hunting spotlight.
Figure 3:
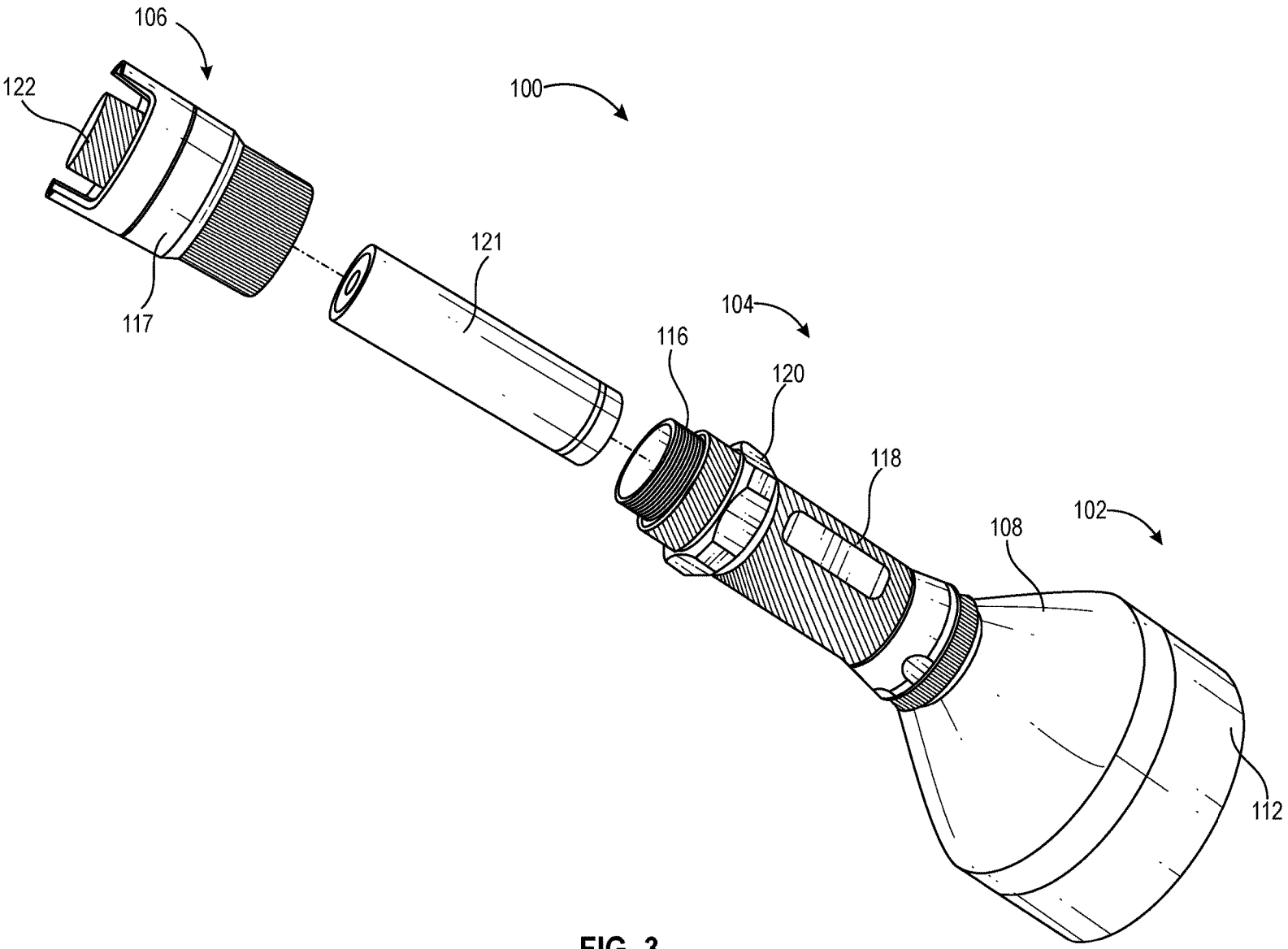
FIG. 3 illustrates a perspective view of a night hunting spotlight with a tail cap portion and power supply removed therefrom.

In one embodiment, as shown in FIGS. 1-3, a night hunting spotlight 100 comprises a bezel portion 102, a body portion 104, and a tail cap portion 106. The night hunting spotlight 100 may be manufactured from aluminum, plastic, carbon fiber, etc. The bezel portion 102 comprises a bezel 108, a lens 110, and front cover 112 coupleable to the bezel 108. The lens 110 may be a spherical lens, a planar lens, a Fresnel lens, a collimated amplified lens system, or any other type of lens. The bezel portion 102 further comprises an LED (light-emitting diode) module 114 having one or more colored LEDs 115 (e.g., green, white, red, etc.). While an LED module 114 may be shown, it will be appreciated that a laser, light emitting plasma, chip on board, or any other light producing device may be used. The LED 115 may be housed within an LED housing 113.

The body portion 104 comprises an inner housing 116 and an outer housing 118. The inner housing 116 is positionable and slidable inside the outer housing 118 (e.g., telescoping). The outer housing 118 may comprise a grip material on an outer surface. For example, the grip material may be a rubber material or may be grooves cut into the outer surface of the outer housing, or other texturing. The inner housing 116 may comprise a power supply 121 (e.g., a battery) therein. For example, as shown in FIG. 3, the tail cap portion 106 may be removed so as to gain access to the power supply 121. Accordingly, the power supply 121 may be replaceable; however, in some embodiments, the power supply 121 may be rechargeable via a charging port. In one embodiment, the battery may be external to the housing and coupled using a power cable, allowing a user the ability to lighten the weight of the night hunting spotlight 100 as well as use additional batteries without disassembling the night hunting spotlight 100. The inner housing 116 may be coupleable to the LED module 114, allowing the module to be in electrical communication with the power supply 121, such as via spring 128 and other known mechanisms.

Figure 4A:
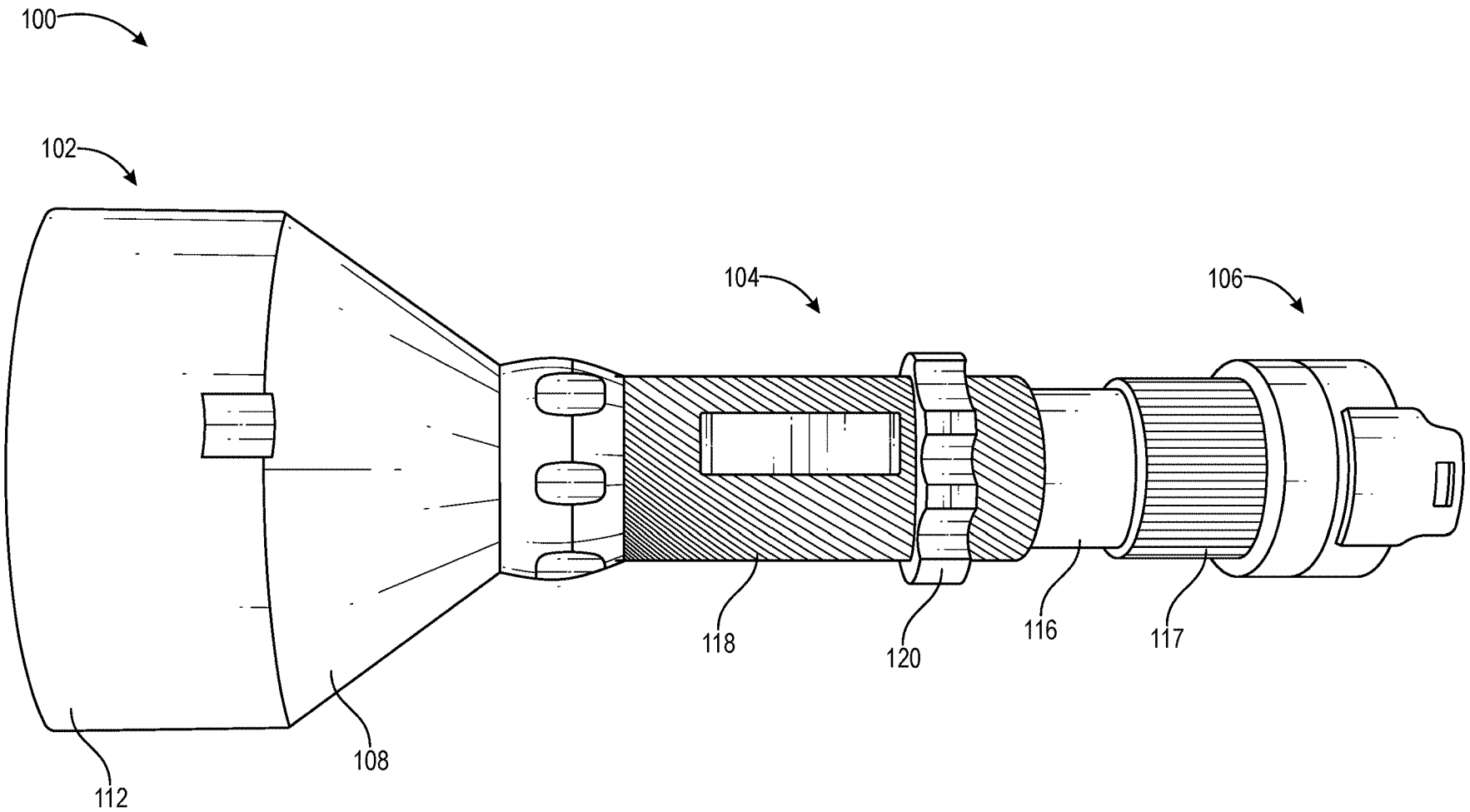
FIG. 4A illustrates a side elevation view of a night hunting spotlight in an extended configuration.
Figure 4B:
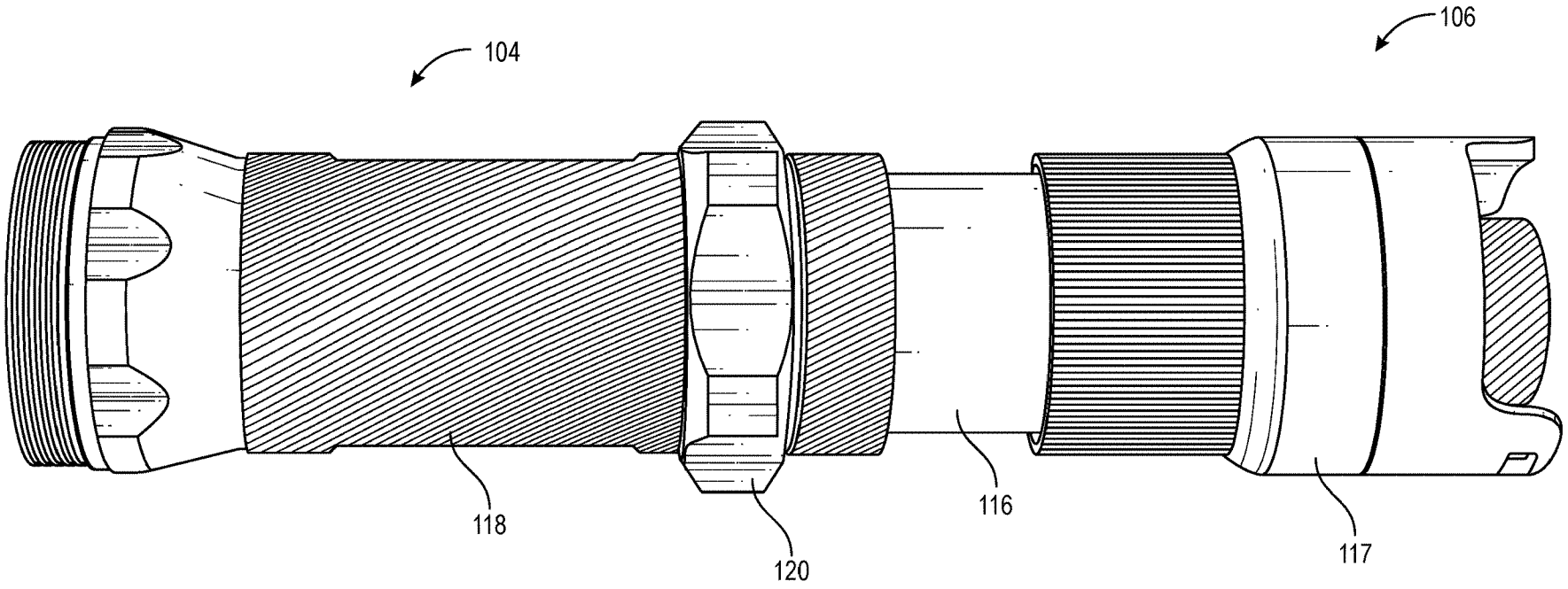
FIG. 4B illustrates a side elevation view of a night hunting spotlight with a bezel removed therefrom in an extended configuration
Figure 5A:
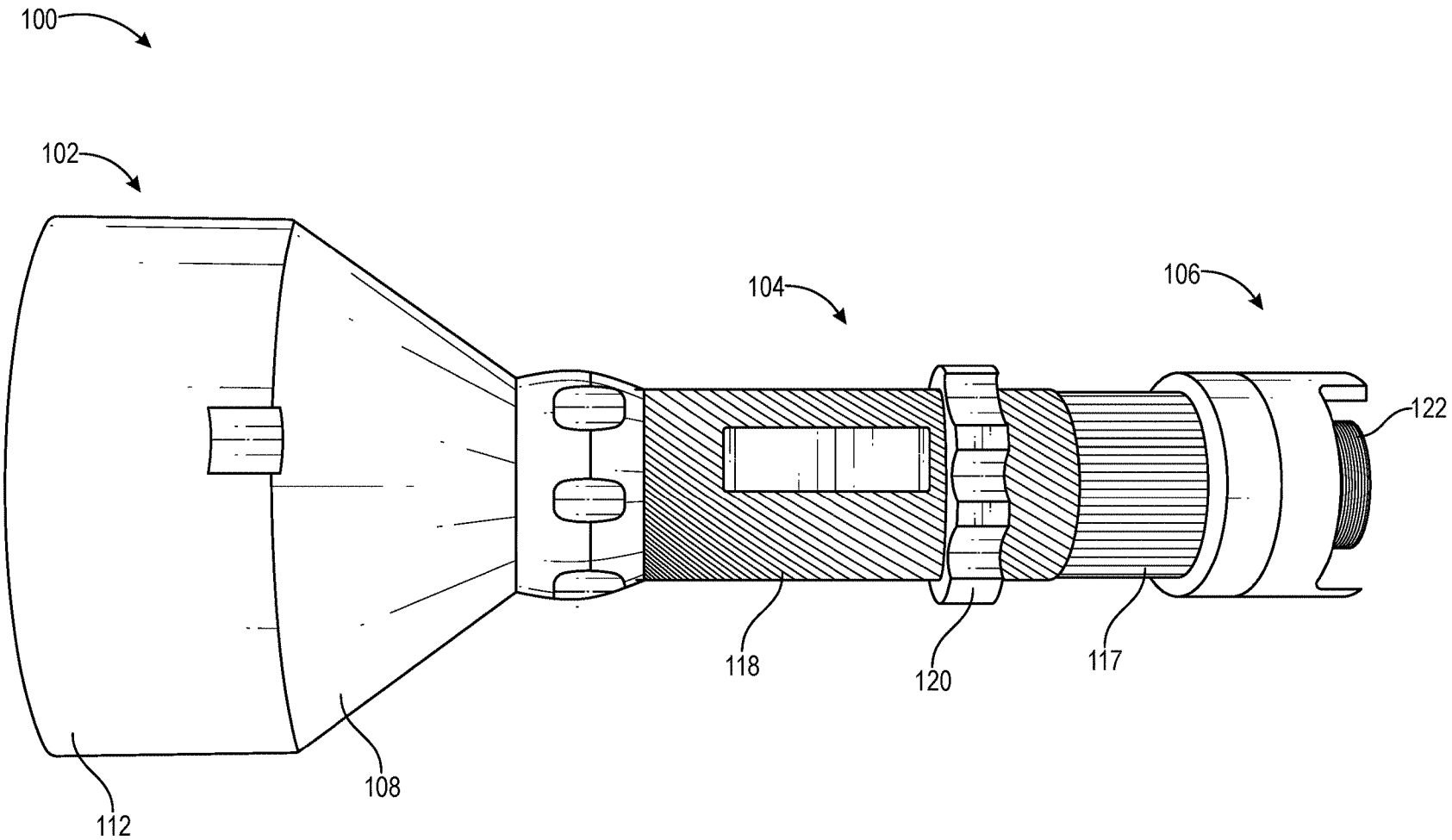
FIG. 5A illustrates a side elevation view of a night hunting spotlight in a retracted configuration.
Figure 5B:
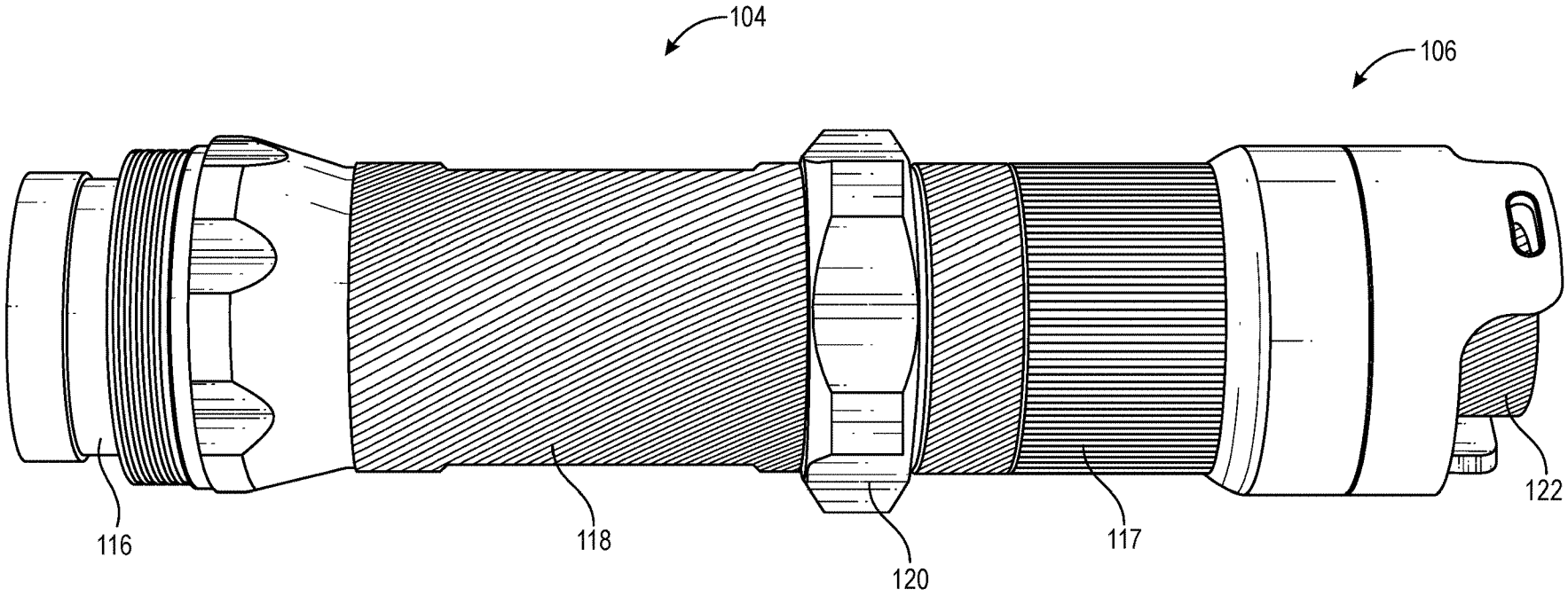
FIG. 5B illustrates a side elevation view of a night hunting spotlight with a bezel removed therefrom in a retracted configuration.
Figure 6:
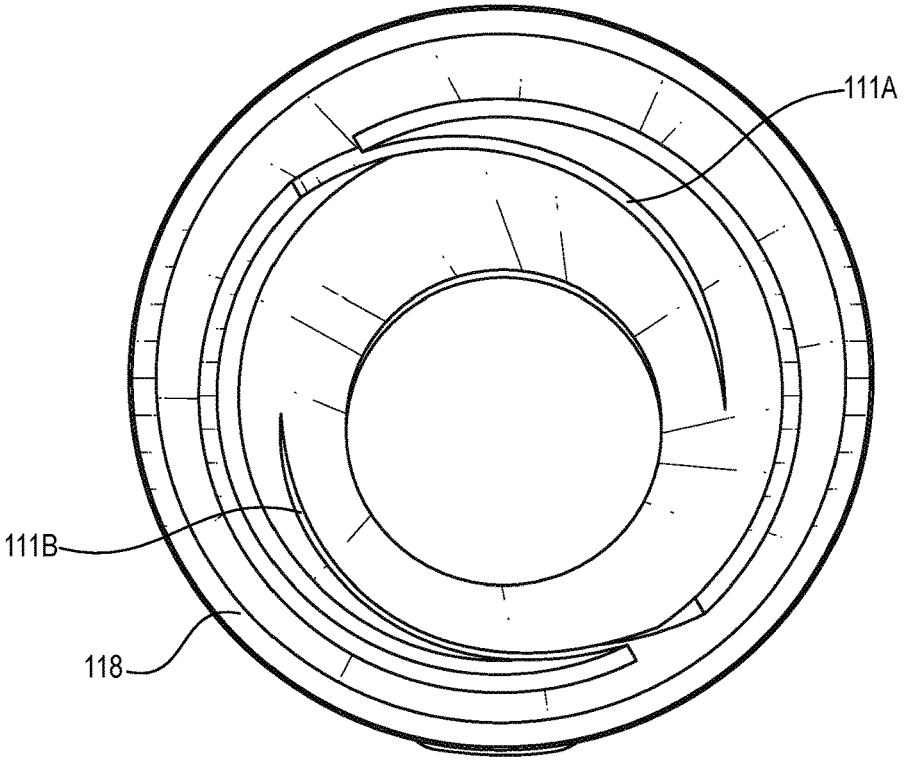
FIG. 6 illustrates a top plan view of an outer housing of a night hunting spotlight.
Figure 7:
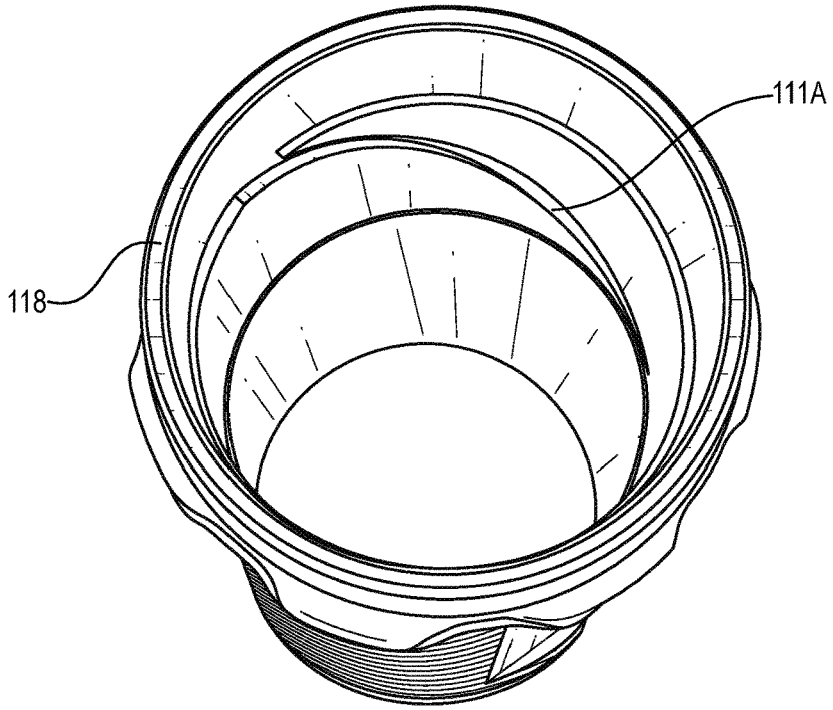
FIG. 7 illustrates a top perspective view of an outer housing of a night hunting spotlight.

Further, the inner housing 116 functions as a telescoping rotator, which may axially extend or retract within the outer housing 118 and, ultimately, move the LED 115 farther from, or closer to, both the bezel 108 and lens 110. In other words, the bezel 108 and lens 110 remain stationary while the LED module 114 (or at least the LED 115) moves along the longitudinal axis of the night hunting spotlight 100. The rotation of the inner housing 116 may be achieved by a focal grip 117, which is coupled to inner housing 116 while remaining exposed so that a user may manipulate the inner housing 116 using the focal grip 117. In one embodiment, the inner housing 116 may comprise one or more protrusions 119 on the outer surface for interacting with one or more grooves 111A, 111B (shown in FIGS. 6 and 7) inside of the outer housing 118 (i.e., the grooves spiral along the longitudinal axis of the inner surface of the outer housing 118). As the protrusion 119 moves inside the groove 111A in the outer housing 118, the inner housing 116 extends (FIGS. 4A and 4B) or retracts (FIGS. 5A and 5B). FIG. 4A illustrates the exposed inner housing 116 when extended, which results in the inner housing being distanced from the lens 110, as shown in FIG. 4B where the portion of the inner housing 116 nearest the lens is withdrawn into the outer housing 118. In contrast, when the inner housing 116 is retracted, it is not exposed to a user, as shown in FIG. 5A. However, as shown in FIG. 5B, when retracted, the upper portion (nearest the lens 110) of the inner housing 116 protrudes from the outer housing 118 nearest the lens 110, as shown in FIG. 5B, thereby positioning the LED 115 closer to the lens 110.

The night hunting spotlight 100 may further comprise a lock 120 to fix the position of the LED module 114 in relation to the lens 110 by securing the position of the inner housing 116. In other words, the lock 120 may be operably coupled to the inner housing 116 so as to prevent axial and longitudinal movement of the inner housing 116. The lock 120 may comprise a jam nut 123 or any other suitable securing mechanism. It will be appreciated that the lock 120 eliminates unwanted movement of the LED module 114 via accidental rotation of the exposed focal grip 117. For example, if the lock 120 is comprises a jam nut 123, the lock 120 may be loosened by unthreading, thereby allowing the jam nut 123 to be freed, which allows a user to rotate the focal grip 117 in a first direction. Because the focal grip 117 is coupled to the inner housing 116, the protrusion 119 moves inside a groove within the outer housing 118, moving the LED module 114 and LED 115 closer to the bezel 108 and lens 110, flooding the light. Once the desired position is achieved, the user may then thread the lock 120, engaging the jam nut 123, which then secures the focal grip 117 and inner housing 116, preventing both from moving. To change the beam zoom-flood position and/or intensity, a user may again loosen the lock 120 and then actuate the focal grip 117 accordingly.

Referring to FIGS. 4A-4B, the inner housing 116 is shown in an extended position (extending rearwardly, away from the lens 110, from the outer housing 118), thereby narrowing the light beam. In FIGS. 5A-5B, the inner housing 116 is retracted (extending frontwardly from the outer housing, as shown in FIG. 5B), positioning the LED module 114 closer to the bezel 108 and lens 110, thereby widening the light beam. It will be appreciated that the inner housing 116 may be adjusted to any position between the fully-retracted and fully-extended positions by rotating the focal grip 117 and securing the position with lock 120.

While a rotation of the inner housing 116 inside of the outer housing 118 is shown and described, it will be appreciated that the inner housing 116 may extend and retract within the outer housing 118 without rotating. For example, it may be a push and pull motion instead of a twisting/rotating motion. Additionally, other mechanisms may be used which do not include telescoping action. For example, a lever may extend out of a channel in the side of the outer housing 118, allowing a user to directly slide the LED module 114 or LED 115 coupled to the lever without extending a portion of the housing. The lever may also include locking mechanisms, such as a screw lock (e.g., set screw), tension lock, cam lock, or other mechanism. Further, while discussed herein as being manually actuated, the linear actuation of the LED module 114 may be achieved with electronic means, such as using a motor driven linear actuator. In such a scenario, the motor may be powered by the battery 121 that also powers the LED 115 and may be controlled using buttons or switches. In other words, a night hunting spotlight 100 comprises a fixed lens 110, a fixed bezel 108, and an LED 115 movable in relation to the fixed lens 110 so as to broaden or narrow the beam, respectively. The LED 115 may be movable using telescoping mechanisms, rotating mechanisms, knobs, linear actuators (manually actuated or electronically controlled), or other mechanism capable of moving the LED 115 along the longitudinal axis of the night hunting light to approximate the lens or move distally therefrom.

When the LED module 114 and/or LED 115 moves toward or retracts away from the fixed lens 110, the light beam will broaden or narrow (i.e., flood or zoom). Additionally, while not required, the tail cap portion 106 may comprise an intensity controller (e.g., rheostat 122, potentiometer, etc.), which may adjust the light intensity. Knob 125 may be used to control the rheostat 122. The intensity controller may be in contact with a battery 121 via contact 124 and spring 126. The opposite end of the battery 121 contacts spring 128 to close the circuit and power the printed circuit board (PCB) 130, which controls the LED 115. Other components, such as springs, washers, O-rings, etc. may be used and illustrated, but are not numbered.

The prior art spotlights typically have a rotatable (manually screwing in or out) bezel as a method for changing the focal point between the fixed position LED and bezel-housed lens, which in turn broadens or focuses the light beam. This causes unwanted movement of the light and its focal point. The night hunting spotlight 100 described herein improves the process and keeps the bezel 108 fixed with no movement and uses the movable LED module 114, which changes the focal point based on its distance from the lens 110. When the LED module 114 moves closer to the lens or retracts from the lens, the light beam will broaden or narrow, respectively.

By completely eliminating the rotational and torquing forces associated with cumbersome rotation of the entire bezel assembly, as found in the prior art, to achieve zoom—flooding of the light beam, the night hunting spotlight 100 eliminates the loss of light beam centering (off center axis). Often, this occurs when the bezel is deflected from 0 degrees off centerline in relation to the fixed LED when the bezel is rotated, due to 1) manufacturing tolerances, 2) the leverage expended by hand rotating, 3) the incidental torquing effect on the bezel, and 4) the weight of the bezel.

Further, the night hunting spotlight 100 eliminates adjustable light mount limitations as related to their sensitivities to the leverage expended by hand rotating and the incidental torquing effect on the bezel. In contrast, the bezel weight and adjustability in the prior art are such that internal spring compression can occur, and minute angle of degree offsets are induced during rotation, which shift the light beam adjustment and trajectory during bezel rotation off center axis as previously discussed.

The design and location of the bezel zoom—flood mechanism found in the prior art is problematic. The physical mechanics of the operator having to rotate the large spotlight bezel, which is located at the front of the light, are burdensome while peering through a scoped weapon. Additionally, by applying torque to the bezel, located at the front of the light, a user is more likely to break cheek-weld and force the crosshairs and beam off target. As previously discussed, the night hunting spotlight 100 eliminates these burdens by shifting the zoom—flood control to the rear of the spotlight, typically within 1-3 inches of the users dominate eye while looking through a scope. The reposition of the zoom—flood control disclosed herein results in a much more desirable and ergonomically placed control, with significant reduction in rotation mechanism size and rotation resistance. The reduction of distance, size, and force all aid in maintaining proper cheek-weld on a weapon and virtually eliminate related torquing sensitivities, keeping the light beam on center axis, which are all improvements over the prior art.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A night hunting spotlight comprising:
a fixed bezel;
a fixed lens coupled to the fixed bezel;
a light-emitting diode (LED) coupled to an inner housing, the inner housing slidable within an outer housing to a retracted position and an extended position;
a focal grip coupled to the inner housing on an end opposite the LED;
a lock to prevent axial and longitudinal movement of the inner housing, the lock comprising a jam nut that (a) loosens to allow movement of the inner housing and (b) tightens to prevent movement of the inner housing;
wherein when the inner housing is in the retracted position, the LED is at a first position, proximal to the fixed lens; and
wherein when the inner housing is in an extended position, the LED is in a second location, distal to the fixed lens.

2. The night hunting spotlight of claim 1, wherein the inner housing further comprises a battery.

3. The night hunting spotlight of claim 1, wherein the focal grip rotates to longitudinally extend and retract the inner housing.

4. The night hunting spotlight of claim 1, further comprising one or more colored LEDs.

5. The night hunting spotlight of claim 1, wherein the fixed lens is spherical.

6. The night hunting spotlight of claim 1, wherein the fixed lens is planar.

7. The night hunting spotlight of claim 1, wherein a tail cap portion further comprises an intensity controller.

8. A night hunting spotlight comprising:
a bezel portion comprising:
a fixed bezel,
a front cover coupleable to the bezel,
a fixed lens interposed between the front cover and the fixed bezel, and
a light-emitting diode (LED) module;
a body portion comprising;
an outer housing, and an inner housing comprising a battery therein, the inner housing slidable within the outer housing, the inner housing coupled to the LED module;

a tail cap portion comprising;

a focal grip coupled to the inner housing at an end opposite the LED module, the focal grip rotatable to extend or retract the inner housing in relation to the outer housing;

wherein when the focal grip is rotated in a first direction, the inner housing with the LED module moves closer to the fixed lens and when the focal grip is rotated in a second direction, the inner housing with the LED module moves away from the fixed lens.

9. The night hunting spotlight of claim 8, wherein the body portion further comprises a lock to prevent axial and longitudinal movement of the inner housing.

10. The night hunting spotlight of claim 9, wherein the lock comprises a jam nut that (a) loosens to allow movement of the inner housing and (b) tightens to prevent movement of the inner housing.

11. The night hunting spotlight of claim 9, wherein the tail cap portion further comprises an intensity controller.

12. The night hunting spotlight of claim 8, wherein the LED module comprises one or more colored LEDs.

13. The night hunting spotlight of claim 8, wherein the inner housing comprises a protrusion slidable within a groove of the outer housing.

* * * * *